US008261882B2

(12) United States Patent
Dangrow et al.

(10) Patent No.: US 8,261,882 B2
(45) Date of Patent: Sep. 11, 2012

(54) LADDER LEVELER AND METHOD

(75) Inventors: Joseph C. Dangrow, Fredonia, PA (US); James J. Grebinoski, Mercer, PA (US); David A. Winslow, Hermitage, PA (US)

(73) Assignee: Werner Co., Greenville, PA (US)

( * ) Notice: Subject to any disclaimer, the term of this patent is extended or adjusted under 35 U.S.C. 154(b) by 0 days.

(21) Appl. No.: 11/331,458

(22) Filed: Jan. 14, 2006

(65) Prior Publication Data

US 2007/0163839 A1 Jul. 19, 2007

(51) Int. Cl.
*E06C 7/00* (2006.01)

(52) U.S. Cl. ..... 182/204

(58) Field of Classification Search ..... 182/201, 182/204

See application file for complete search history.

(56) References Cited

U.S. PATENT DOCUMENTS

| | | | | | |
|---|---|---|---|---|---|
| 913,452 | A * | 2/1909 | Bartlett | 182/201 |
| 1,300,430 | A * | 4/1919 | Lunser | 182/205 |
| 2,146,759 | A * | 2/1939 | Panowitz | 182/204 |
| 2,862,553 | A * | 12/1958 | Brehm | 83/68 |
| 3,021,921 | A * | 2/1962 | Poelvoorde et al. | 182/201 |
| 3,394,774 | A * | 7/1968 | Lanier | 182/204 |
| 3,406,785 | A * | 10/1968 | Pilcher | 182/205 |
| 3,791,487 | A * | 2/1974 | Baumann | 182/201 |
| 3,998,293 | A * | 12/1976 | Raia | 182/204 |
| 4,423,797 | A * | 1/1984 | Batten | 182/204 |
| 5,154,257 | A * | 10/1992 | Mirles | 182/201 |
| 5,522,473 | A * | 6/1996 | Moselsky | 182/204 |
| 5,551,529 | A * | 9/1996 | Molitor | 182/204 |
| 5,687,813 | A * | 11/1997 | Bensch | 182/127 |
| 5,718,306 | A * | 2/1998 | Baker | 182/204 |
| 5,845,744 | A * | 12/1998 | Beck et al. | 182/204 |
| 6,234,273 | B1 * | 5/2001 | Moore | 182/204 |
| 6,935,463 | B2 | 8/2005 | Brewster | |
| 2005/0092551 | A1 * | 5/2005 | Caldwell | 182/204 |

* cited by examiner

*Primary Examiner* — Alvin Chin Shue
(74) *Attorney, Agent, or Firm* — Ansel M. Schwartz

(57) ABSTRACT

A leveler for a ladder having side rails and a rung comprises a metal housing fixed to one of the side rails. The housing has an opening. The leveler comprises a metal leg with slides in the housing and is adjustable in the housing. The leg has a top end and a bottom end. The leg has two rows of holes which are set side by side and extend through the leg. The leveler comprises a holder for holding a leg to the housing. The holder extending through the opening and one of the holes to hold a leg in place. The leveler comprises a cap disposed on the top end which acts as a stop for the leg when the cap contacts the housing. A method for setting a ladder in place.

7 Claims, 1 Drawing Sheet

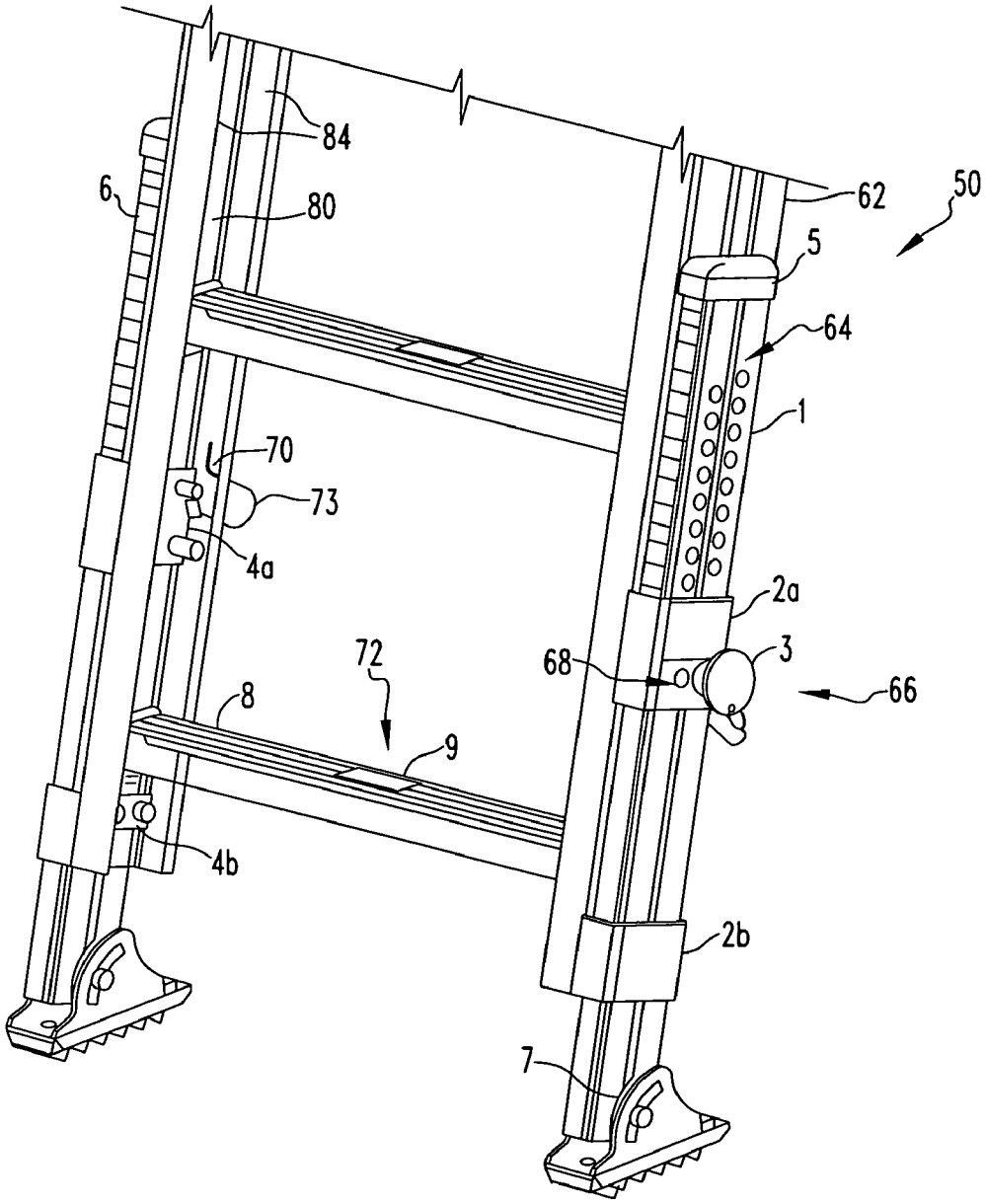
84
6
80
62
50
5
64
1
70
73
4a
2a
72
68
3
66
8
9
4b
2b
7

LADDER LEVELER AND METHOD

CROSS-REFERENCE

This application is related to contemporaneously filed U.S. design patent application Ser. No. 29/251,863, titled "Ladder Bottom With Levelers", by Joseph C. Dangrow, James J. Grebinoski and Sergio De Oliveira, incorporated by reference herein.

FIELD OF THE INVENTION

The present invention is related to a ladder leveler. More specifically, the present invention is related to a ladder leveler having a metal housing fixed to one of the side rails, a metal leg which slides in the housing and is adjustable in the housing, a holder for holding the leg to the housing through an opening and one of a plurality of holes in the housing to hold a leg in place, and a cap which acts as a stop for the leg when the cap contacts the housing.

BACKGROUND OF THE INVENTION

When setting up an extension ladder, the surface or ground that supports the ladder is often uneven. It is not uncommon for consumers to place blocks under the ladder to help even it up or dig into the ground on one side. Other consumers use levelers that are currently available in the marketplace. Usually, these levelers require the consumer to modify their ladder by drilling holes and/or cutting the side rails. The purpose of this invention is to provide a leveler which is integrated on a ladder from the factory. This will allow consumers to level their ladder without blocking, digging, or modifying their ladder in any way.

Also, consumers are left to use their best judgment about how level a ladder is side to side. In order to help the consumer in this endeavor, the invention incorporates a carpenter's grade bubble level attached to the first rung. This bubble level will serve as a guide when the consumer is setting up the ladder.

SUMMARY OF THE INVENTION

The present invention pertains to a leveler for a ladder having side rails and a rung. The leveler comprises a metal housing fixed to one of the side rails. The housing has an opening. The leveler comprises a metal leg which slides in the housing and is adjustable in the housing. The leg has a top end and a bottom end. The leg has two rows of holes which are set side by side and extend through the leg. The leveler comprises a holder for holding the leg to the housing. The holder extends through the opening and one of the holes to hold the leg in place. The leveler comprises a cap disposed on the top end which acts as a stop for the leg when the cap contacts the housing.

The present invention pertains to a method for setting a ladder in place. The method comprises the steps of leaning a top edge of the ladder against a work surface. There is the step of positioning the ladder until a bubble of a rung of the ladder indicates a level reading. There is the step of sliding a metal leg in a housing of a leg attached to a rail of the ladder. There is the step of inserting a pin through a hole of two rows of holes which are set side by side and extend through the leg and through an opening of the housing.

BRIEF DESCRIPTION OF THE DRAWING

In the accompanying drawing, the preferred embodiment of the invention and preferred methods of practicing the invention are illustrated in which:

FIG. 1 is a perspective view of the ladder leveler of the present invention.

DETAILED DESCRIPTION

Referring now to the drawings wherein like reference numerals refer to similar or identical parts throughout the several views, and more specifically to FIG. 1 thereof, there is shown a leveler 50 for a ladder having side rails 62 and a rung. The leveler 50 comprises a metal housing 60 fixed to one of the side rails 62. The housing 60 has an opening 68. The leveler 50 comprises a metal leg 1 which slides in the housing 60 and is adjustable in the housing 60. The leg 1 has a top end and a bottom end. The leg 1 has two rows of holes 64 which are set side by side and extend through the leg 1. The leveler 50 comprises a holder 66 for holding the leg 1 to the housing 60. The holder 66 extends through the opening 68 and one of the holes 64 to hold the leg 1 in place. The leveler 50 comprises a cap 5 disposed on the top end which acts as a stop for the leg 1 when the cap 5 contacts the housing 60. The side rail 62 is defined by a web 80 and opposing flanges 84 extending from the web 80 to form a c shape.

Preferably, the leveler 50 includes a level 9 attached to the first rung. The leveler 50 preferably includes a swivel shoe rotatably connected adjacent to the bottom end of leg 1. Preferably, the holder 66 includes a pin 3. The housing 60 preferably includes an upper housing portion 2*a* and a lower housing portion 2*b* spaced apart from the upper housing portion 2*a*. Preferably, the leveler 50 includes studs 70 which are pressed into the upper housing portion 2*a* and the lower housing portion 2*b* and attached to the side rail 62 to fix the upper housing portion 2*a* and the lower housing portion 2*b* to the side rail 62. The pin 3 is preferably a steel ball detent pin.

Preferably, the metal housing 60 is a closed section. The upper housing portion 2*a* is preferably a closed section and the lower housing portion 2*b* is a closed section. Preferably, the leveler 50 includes a case 72 in which the level 9 is disposed, and the rung has a cavity in which the case 72 is disposed with the level 9. The leveler 50 preferably includes a cable 73 connected to the pin 3 and the upper housing portion 2*a*. Preferably, the steel ball detent pin 3 is spring loaded. The front surface of the leg 1 preferably has hash-mark labels 6 which serve as an indicator of alignment of the holes 64. Preferably, the leveler 50 includes a spacer 7 disposed between the leg 1 and the swivel shoe to ensure proper function between the swivel shoe and the leg 1.

The present invention pertains to a method for setting a ladder in place. The method comprises the steps of leaning a top edge of the ladder against a work surface. There is the step of positioning the ladder until a bubble of a rung of the ladder indicates a level reading. There is the step of sliding a metal leg 1 in a housing 60 of a leg 1 attached to a rail of the ladder. There is the step of inserting a pin 3 through a hole of two rows of holes 64 which are set side by side and extend through the leg 1 and through an opening 68 of the housing 60.

In the operation of the preferred embodiment, the leveler 50 is constructed of a closed section aluminum leg 1 which slides in a closed section aluminum housing 60. The housing 60 is attached to the ladder by studs 70 which are pressed into the housing 60. The leg 1 is adjustable in the housing 60 and is held in place by a steel ball detent pin 3. The pin 3 locks the leg 1 to the housing 60 and ladder side rails 62. Furthermore, the pin 3 has a molded plastic handle to make it easier and more comfortable for the consumer to use. The pin 3 is tethered to the ladder by a steel cable 73. There is molded plastic cap 5 on the end of the leg 1 which also acts as a stop for the leg 1, preventing it from falling out of the housing 60 when the pin 3 is removed. The leg 1 has two series of holes 64 side by side in order to obtain a finer adjustment.

Also as part of the invention, there is a carpenter's grade bubble level 9 attached to the first rung. This bubble is placed in a plastic housing 60 which snaps into a cavity in the rung. This housing 60 also holds a plastic rung cover 8 in place. The purpose of the bubble is to serve as a guide to help the consumer set their ladder level 9 from side to side.

Inner Leg 1—The inner leg 1 is a rectangular closed box section. It is constructed of aluminum. Each leg 1 as two rows (series) of holes 64 which are set side by side and offset ⅜" vertically from each other. These holes 64 provide 8.25" of adjustment in ⅜" increments. These holes 64 go though both walls of the rectangular box section. The leg 1 also provides a means to attach an end cap 5 at the top and a foot at the bottom.

Housing 60 and upper and lower housing portions 2*a* and 2*b* —The upper and lower housing portions 2*a*, 2*b* are a rectangular closed box section. It is constructed of aluminum. There are two housings on each side of the ladder, an upper housing portion 2*a* and lower housing portion 2*b*. The upper housing portion 2*a* has two holes 64 side by side which line up with series of holes 64 in the leg 1. These holes 64 are sized to accept a steel ball detent pin 3. Furthermore, the upper housing portion 2*a* has two studs 70 which are pressed into the back side of the housing 60. These studs 70 serve as a means to attach the upper housing portion 2*a* to the ladder. The lower housing portion 2*b* also has two studs 70 which are pressed into the back side of the housing 60. These studs 70 serve as a means to attach the lower housing portion 2*b* to the ladder.

Locking Pin 3 with knob and Lanyard 73—The locking pin 3 with knob and lanyard 73 comprises a zinc plated steel pin with a spring loaded ball detent. The end of the pin 3 has molded plastic knob which servers as a grip surface for the consumer as well as an indication that the pin 3 is completely engaged. The molded knob has a wire lanyard 73 attached. The other end or the wire lanyard 73 attaches to one of the studs 70 in the upper housing portion 2*a*. This helps prevents the pin 3 from being lost while or misplaced when the pin 3 is removed.

Back Up Plates 4*a* and 4*b*—The back up plates 4*a*, 4*b* are constructed of medium grade zinc plated steel. These plates serve as a washer for the nut that is used to attach the upper and lower housing portions 2*a*, 2*b* to the ladder rail. Also the back up plate serves as a safety device and reinforcing plate around the hole in the ladder rail that the pin 3 goes though.

End-Cap 5 functionality—The end cap 5 is made from an injection molded nylon. The cap 5 has two tabs which allow it to snap into the top end of the leveler 50 leg 1 and be held in place. The profile of the cap 5 is such that it is larger than the leveler 50 leg 1 profile, and closely matches the profile of the outer housing 2*a*, 2*b*. This feature allows the end cap 5 to serve as a stop for the leg 1 when the pin 3 is removed. The cap 5 will hit the upper housing portion 2*a*, keeping the leg 1 attached to the ladder at all times.

Hash-Mark Labels 6—There is a label on the front surface of the leg 1 which serves as an indicator of alignment of the adjustment holes 64. The labels has a series of hash marks and when one of the marks lines up with the top edge of the upper housing portion 2*a*, there is alignment between one of the holes 64 in the outer housing 2*a*, 2*b* and the leg 1. This is a visual indicator to aid the consumer during setup.

Foot Spacer 7—A plastic molded spacer 7 is used to take up space and ensure proper function between the ladder swivel shoe and the leg 1 to which it is attached. The spacer 7 is made of injection molded polypropylene and has features designed into it which allow it to snap onto the lower portion of the leg 1.

Rung Cover 8—The rung cover 8 is made of injection molded nylon.

Rung Mounted Bubble Level 9—The bubble level 9 is a standard grade carpenter's level. It is mounted into an injection molded housing 60 and recessed into the lower rung of the ladder. This level 9 serves as a guide of the side to side levelness of the ladder.

Setting up the Ladder

The preferred method for using the leveler 50 while setting up the ladder is as follows:

1. Place the ladder on the ground where the work is to be performed. Lean the top edge of the ladder against the work surface.
2. Remove pin 3 from the downhill side of the ladder. Leveler 50 leg 1 should be free to move.
3. Using the bubble as a guide, position the ladder until the bubble indicates a level reading.
4. Using the tick mark label as a guide, align the nearest tick mark with the top edge of the housing 60. (OPTIONAL)
5. Insert ball detent pin 3 through the housing 60 and leveler 50 leg 1.
6. Make sure both feet are touching the ground and recheck the bubble level 9 indicator. Readjust if necessary.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A leveler for a ladder having side rails defined by a web and opposing flanges extending from the web to form a c shape with rail holes and a rung comprising:

a metal housing consisting of a pair of separate unconnected housing portions fixed to one of the side rails, said pair of housing portions include an upper housing portion fixed to the rail and a lower housing portion fixed to the rail spaced apart from the upper housing portion, the upper housing portion is a closed rectangular box section and the lower housing portion is a closed rectangular box section, the upper housing portion has two holes side by side; each of the housing portion includes a pair of studs which are pressed into the upper housing portion and the lower housing portion and attached to the side rail to fix the upper housing portion and the lower housing portion to the side rail;

a rectangular closed box section metal leg which slides in the housing and is adjustable in the housing, the leg has a top end and a bottom end, the leg has two rows of holes which are set side by side but offset vertically from each other and extend through the leg, the two holes of the upper housing portion line up with the two rows of holes;

the front surface of the leg has hash-mark labels which serve as an indicator of alignment of the rows of holes;

a holder includes a pin for holding the leg to the housing, the pin extending through the opening of one of the two holes of the upper housing portion to hold the leg in place;

nuts that are used to attach the upper and lower housing portions of the housing to the web of the rail between the flanges;

a pair of backup plates disposed between the nut and the side rail, each plate comprising a pair of holes receiving the pair of studs and serves as a washer for the nut that attaches the plate to the rail, each plate further comprises a third hole receiving the pin and also serves as a safety device and reinforcing plate around a rail hole in the rail the pin goes through, the rail disposed between the plate and the upper and lower housing portions;

a cap disposed on the top end which acts as a stop for the leg when the cap contacts the housing; and a swivel shoe rotatably connected adjacent to the bottom end of the leg.

2. A leveler as described in claim 1 including a level attached to the first rung.

3. A leveler as described in claim 1 wherein the pin is a steel ball detent pin.

4. A leveler as described in claim 3 including a case in which the level is disposed, and the rung has a cavity in which the case is disposed with the level.

5. A leveler as described in claim 4 including a cable connected to the pin and the upper housing portion.

6. A leveler as described in claim 5 wherein the steel ball detent pin is spring loaded.

7. A leveler as described in claim 1 including a spacer disposed between the leg and the swivel shoe to ensure proper function between the swivel shoe and the leg.

* * * * *